United States Patent [19]

Reder

[11] 4,380,163

[45] Apr. 19, 1983

[54] TAMPER-RESISTANT LOCK

[76] Inventor: Kenneth J. Reder, 1837 Midland Rd., Bay City, Mich. 48706

[21] Appl. No.: 300,323

[22] Filed: Sep. 8, 1981

[51] Int. Cl.[3] ..... E05B 15/14; E05B 27/06; E05B 63/00

[52] U.S. Cl. ..... 70/364 A; 70/378; 70/421

[58] Field of Search ..... 70/364 A, 376, 378, 70/382, 416, 419, 421

[56] References Cited

U.S. PATENT DOCUMENTS

| | | | |
|---|---|---|---|
| 2,062,010 | 11/1936 | Neer | 70/378 |
| 2,836,973 | 6/1958 | Schillizzi | 70/421 |
| 3,349,588 | 10/1967 | Hines | 70/378 |
| 3,494,158 | 2/1970 | Bauer | 70/378 |
| 3,802,234 | 4/1974 | Gerlach | 70/378 |
| 4,137,739 | 2/1979 | Keller | 70/419 |

*Primary Examiner*—Robert L. Wolfe

*Attorney, Agent, or Firm*—Vito J. DiPietro; Thomas J. Scott, Jr.

[57] ABSTRACT

The invention relates to a tamper-resistant lock. The improved lock incorporates metal wafers which rest on the bottom pins in the inner cylinder of a cylindrical key lock. The wafers and the pins upon which they rest alternately incorporate holes in their topside. The wafers and the bottom pins cooperate with trap pins housed in the outer cylinder of the lock at a 45° angle from the vertical insertion position of the key. The trap pins are urged into the holes in the wafers and bottom pins when tampering occurs. This apparatus prevents both the picking or impressioning of the lock, common alternative techniques for opening a key lock without the key. The improved lock also incorporates a feature to prevent unauthorized opening by rapid spinning of the lock by a spring-propelled insert placed into the lock cylinder after it has been picked.

2 Claims, 8 Drawing Figures

TAMPER-RESISTANT LOCK

GOVERNMENT LICENSE

The invention described herein may be manufactured or used by or for the Government of the United States of America without the payment of any royalties thereon or therefore.

SUMMARY OF DISCLOSURE

This invention pertains to a cylinder key lock which incorporates tamper-resistant features. The improved lock of this invention will resist the most commonly used techniques for opening a cylinder key lock without the appropriate key, namely, (a) picking, (b) impressioning or (c) rapid spinning of the rotating element of the lock.

The lock of the invention incorporates a trapping element which will lock the cylinder when tampering occurs.

BACKGROUND OF THE INVENTION

Cylinder key locks are conventionally used to secure many types of entrances. Their structure and operation are well-known and they are thus frequently subjected to tampering to gain unauthorized access.

The structure and operation of conventional cylinder key locks are described, for example, in U.S. Patent to Bauer et al. No. 3,494,158 and U.S. Patent to Murphy No. 3,541,822. In such locks, a rotatable inner cylinder or plug is housed in a larger fixed outer cylinder. In each of these cylinders, there are an in-line group of chambers which house upper and lower pins. The chambers in the two cylinders are disposed so that they are aligned when the lock is in the locked position. The inner cylinder has below the chambers a key slot. To operate the lock, a key is inserted through a restricted opening in the outer face of the inner cylinder, into this key slot. When the key is inserted, the upper edge of the key which is at various elevations raises the various pins in the aligned pin chambers. When the key is fully inserted, the pins are raised in their chambers such that the shear line between the upper and lower pins in each chamber is coincident with the meeting point of the aligned lower and upper chambers. Thus, with the key fully inserted, the inner cylinder may be rotated effecting the unlocking of the lock.

Such conventional cylinder key locks are susceptible to tampering and unauthorized opening. Two alternative techniques for such unauthorized opening are called picking and impressioning. Picking involves the use of a small tool which is inserted into the key slot and is then used to raise the upper and lower pins in the aligned chambers. As the pins are raised, a torsional force is imparted to the inner cylinder. When the pins reach the point at which the shear line is coincident with the boundary between the inner and outer cylinders, the inner cylinder will move slightly, or in some cases snap to a new position, because of the play in the lock. Under this condition, the upper pin may be mounted on the upper edge of the lower pin chamber on the inner cylinder. The process is repeated for each set of pins. When the process is complete, the lock may be opened.

Impressioning involves placing a key blank into the key slot and filing down the portion of the blank under each group of pins until the shear line is reached. The position of the shear line is determined much the same way as with picking. Each of these alternative techniques involves the raising or lowering of the pins until a point of lower resistance to the torsional force on the inner cylinder is reached and noticed by the tamperer.

A third technique for unauthorized opening which is effected in conjunction with picking the lock involves the rapid spinning of the inner cylinder with a spring-propelled insert.

Prior art cylinder key locks have incorporated features whose objective was resistance to tampering and unauthorized opening. Such prior art locks are disclosed in the previously mentioned Bauer et al. and Murphy patents and in U.S. Patent to Hines No. 3,349,588. These prior art devices use traps or recesses in the pin faces to resist one of the tampering techniques. None of the prior art techniques are capable of resisting all of the above described techniques.

It is therefore an object of this invention to provide a lock apparatus with features to resist a variety of tampering techniques. It is another object of this invention to trap the tampering tools inside the lock and to provide additional locking apparatus to prevent further tampering once the initial tampering has been attempted. It is a further object of this invention to resist not only the various tampering techniques individually but also when a tamperer attempts to use them in combination. Another object of the invention is to insure that the proper user of the lock is aware that tampering has been attempted.

Other objects of this invention will appear from the following description and the appended claims.

SUMMARY OF THE INVENTION

The invention contemplates a conventional lock in which metal wafers are placed on the top surface of the lower pins. In the middle chambers the wafers and the bottom pins upon which they rest alternately incorporate holes in their topside. The wafers and the bottom pins in these chambers cooperate with trap pins which are housed in the outer cylinder of the lock at substantially a 45° angle from the vertical insertion position of the key. The trap pins are urged into the holes in the wafers or bottom pins when tampering occurs. Thus, the apparatus of this invention prevents both the picking or impressioning of the lock.

The first and last chambers have several wafers disposed between the upper and lower pins. One of these wafers has a recess in its side. When the proper key is used, the lower tumbler is raised to a level that this particular wafer will pass a ridge mounted on the inner cylinder and the lock will open. If the lock is picked and the tamperer attempted to bypass the trap pins by rapidly spinning the inner cylinder, a wafer without the recess will stop the inner cylinder at the angle on which the trap pins are disposed and allow them to engage either a wafer or a bottom pin.

BRIEF DESCRIPTION OF THE DRAWINGS

FIG. 4(*b*) is a view of the arrangement of bottom pins and wafers designed to prevent rapid spinning of a picked lock.

DESCRIPTION OF THE PREFERRED EMBODIMENTS

Figure 1:
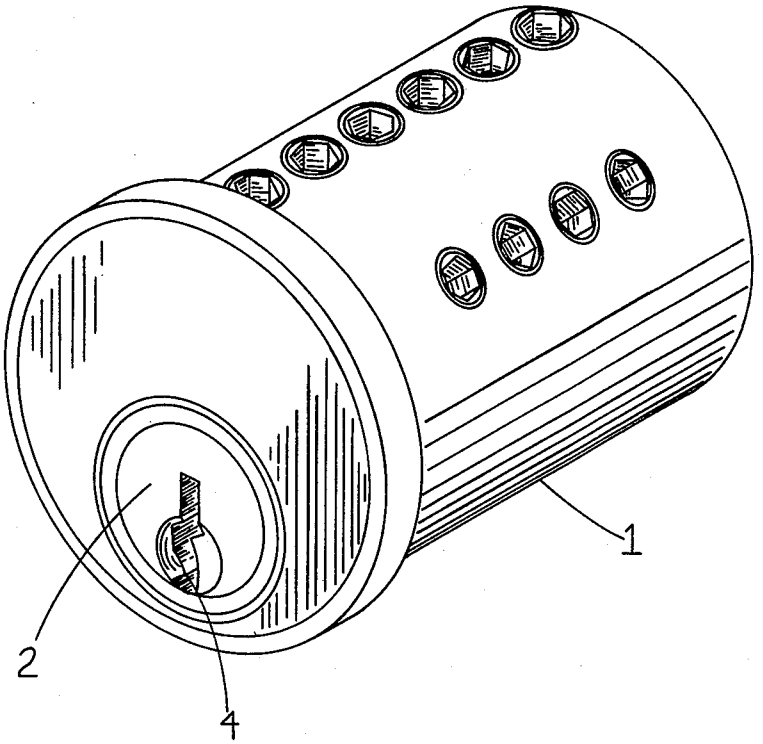
FIG. 1 is a perspective view of a cylinder lock of the present invention.
Figure 2:
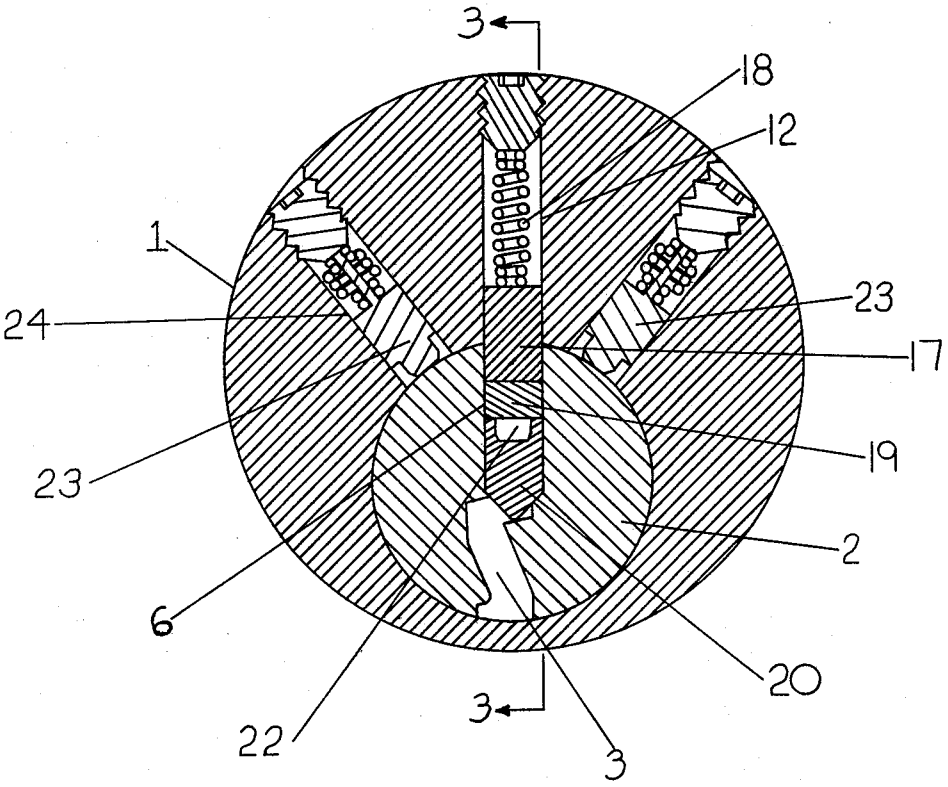
FIG. 2 is a front view of the lock cut away to expose interior details of the lock.

As shown in FIGS. 1 and 2, a lock in accordance with the present invention may have an outward shape similar to conventional locks. The lock has an outer cylinder 1 in which a rotatable inner cylinder 2 is disposed. In the inner cylinder 2, a key slot 3 is formed to receive a key through key opening 4 in the outer face of the inner cylinder.

Figure 3:
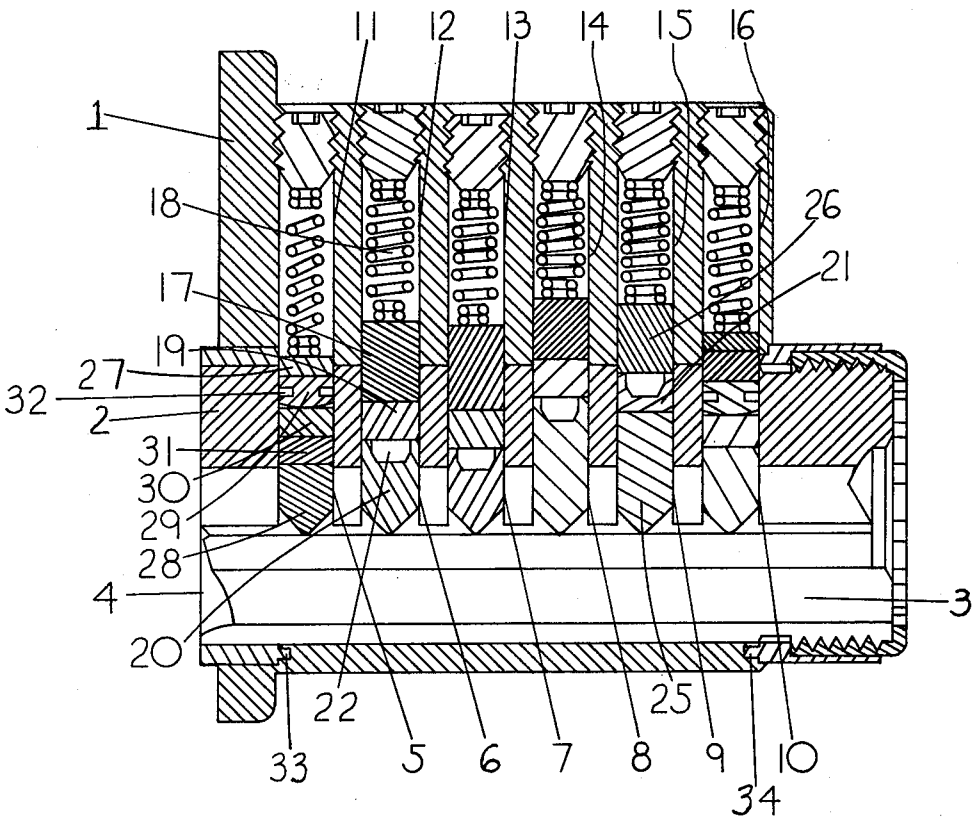
FIG. 3 is a side view of the lock taken along line 3—3 in FIG. 2 and looking in the direction of the arrows.

As shown in FIG. 3, six chambers 5–10 are formed in the inner cylinder above the key slot and six upper chambers 11–16 are formed in the outer cylinder of the lock.

Springs are disposed in the upper portion of each of the upper chambers 11–16, respectively, to urge the upper pins downwardly. As shown in FIG. 2, spring 18 downwardly urges upper pin 17 in chamber 12. Disposed below the pin 17 is a wafer 19 and a lower pin 20. In upper chambers 13–15 and corresponding lower chambers 7–9 the arrangement is similar.

Figure 4A:
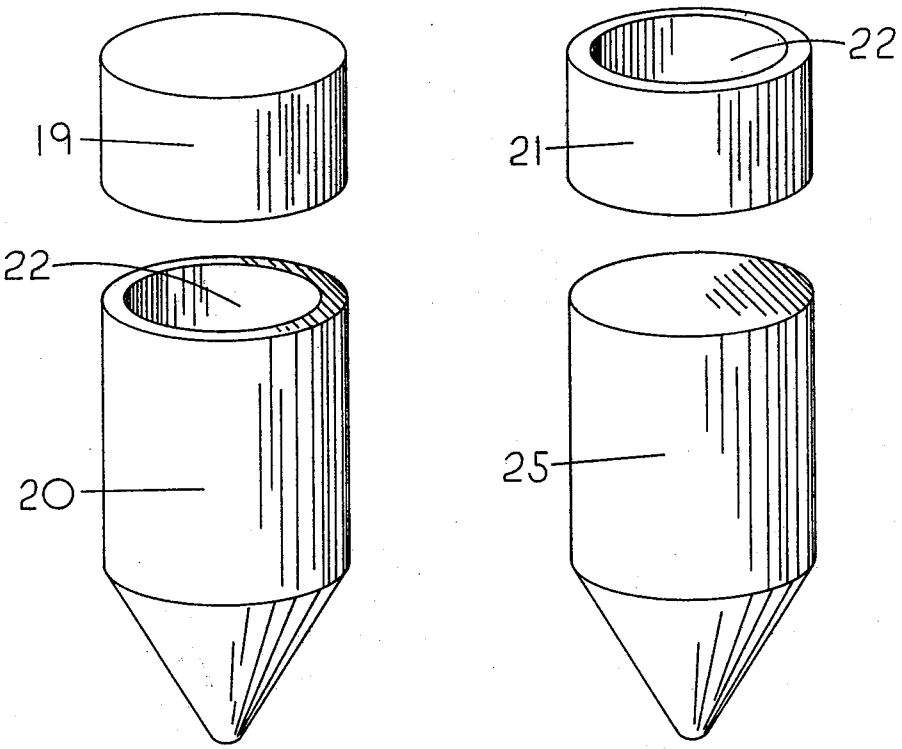
FIG. 4(*a*) is a view of the alternative arrangements of the bottom pins and wafers, designed to resist alternative forms of tampering either picking or impressioning.
Figure 4B:
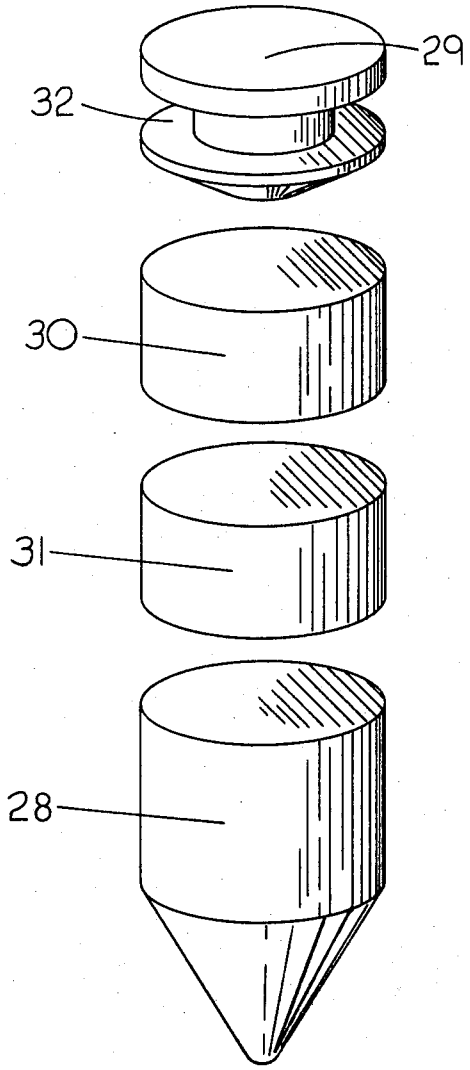
Figure 6:
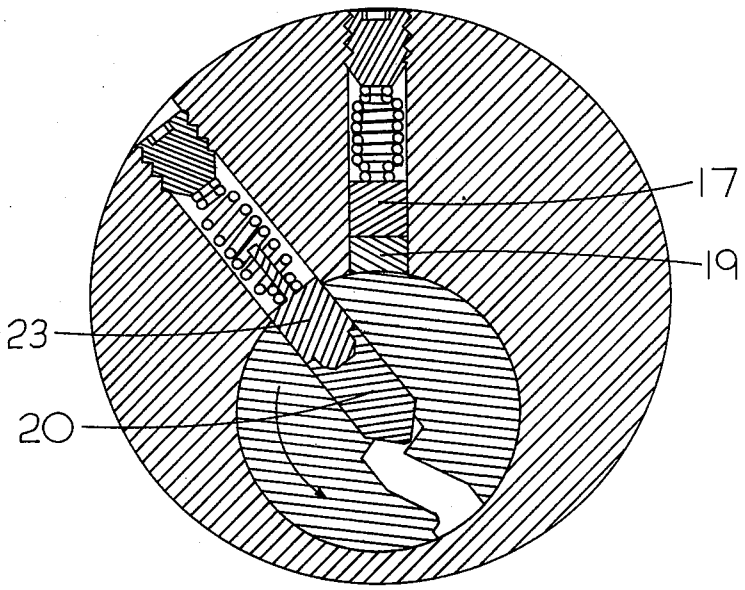
FIG. 6 is a front view of the interior of the lock with the trap pin engaged after tampering has been attempted.

As shown in FIG. 4(*a*), lower pin 20 contains an opening or hole 22. The lower pins in chamber 7 and 8 also have a similar hole or opening. As also shown in FIG. 4(*a*) the wafer 21 mounted on lower pin 25 in lower chamber 9 contains an opening or hole 22. As shown in FIG. 6, opening 22 is designed to receive the trap pin 23 disposed in a trap pin chamber 24 when the lock is tampered with by the techniques of picking or impressioning. The arrangement in upper chambers 11 and 16 and lower chambers 5 and 10 is somewhat different. As shown in FIG. 4(*b*), three wafers are disposed between the upper and lower pins. These are of two different types. Two of the wafers 30 and 31 are solid. The third wafer 29 contains a recess 32 in the center of its side surface. The wafers 29, 30 and 31 cooperate with the ridge 32 shown in FIGS. 3 and 7 to prevent the rapid spinning of the picked lock.

In normal operation, the lock of this invention operates in substantially the same way as a conventional prior art lock as described above. When the lock is locked, the lower chambers 5–10 are aligned with the upper chambers 11–16. As shown in FIG. 2, in the locked position the spring 18 urges the pin 17 into the upper position of the lower chamber 6. To open the lock normally, the key is inserted through the key opening 4 and into the slot 3 raising the pins and wafers to the shear line between the inner and outer cylinder. The key is then rotated. Since the pins or wafers presents a flat surface to the trap pins, they will slide past the trap pins and open the lock.

When a tamperer attempts to pick the lock, he will raise the lower pin 25 in chamber 9 with a small tool until he reaches the first shear line which will be between the upper pin 26 and the wafer 21. After the tamperer has picked the pins in each of the chambers, he will rotate the inner cylinder 2. As the wafer 21 passes the trap pin chamber, the trap pin 23 will be urged into the hole 22. When engaged, the trap pin 23 prevents further rotation of the cylinder.

When the tamperer attempts to impression the lock, he will place the blank key in the slot 3. The pins and wafers are lowered by removing material from the blank until the tamperer reaches the shear line for the pins and wafers, for example, in chambers 12 and 6 between the wafer 19 and the lower pin 20. As shown in FIG. 4(*a*) the lower pin 20 contains the hole 22. As shown in FIG. 6, hole 22 in lower pin 20 will engage the trap pin disposed at an angle from the vertical when lower pin 20 passes the trap pin chamber.

Figure 5:
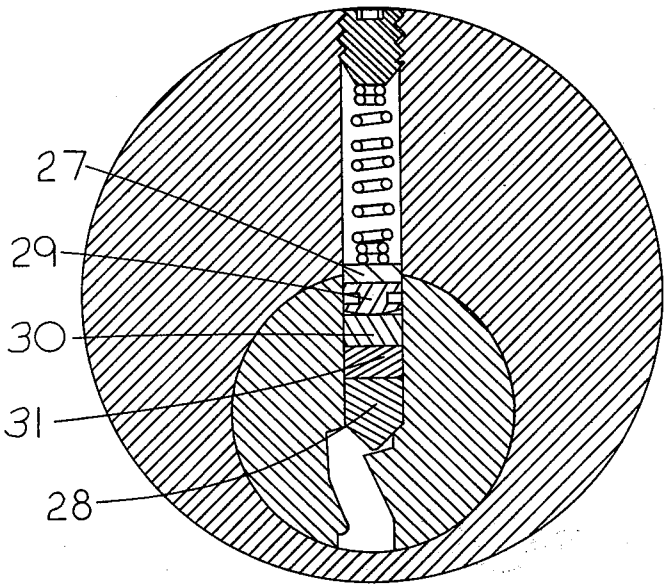
FIG. 5 shows the arrangement of the wafers and bottom pins which prevents rapid spinning of the inner cylinder to by-pass the trap pins.
Figure 7:
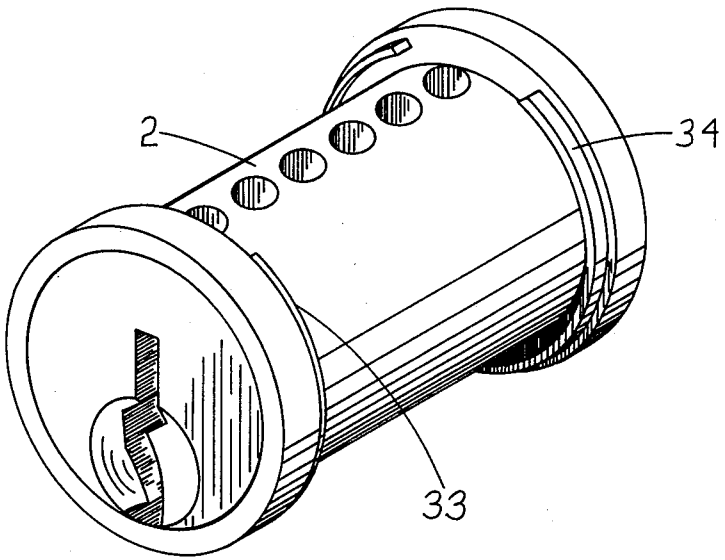
FIG. 7 is a perspective view of the inner cylinder which particularly shows the ridge mounted on the inner cylinder designed to prevent rapid spinning of the lock.

When the tamperer attempts to pick the lock and then very rapidly moves the inner cylinder past the trap pins so as to prevent them from engaging the holes, he will be prevented from doing so by the group of wafers disposed in chambers 5 and 10 and 11 and 16. As shown in FIG. 3 and 5, in chambers 5 and 11, there are at least three wafers disposed between the upper pin 27 and the lower pin 28. As shown in FIG. 4(*b*) these wafers 29, 30, 31, are of two different types. Two of the wafers are solid. The third wafer 29 contains a recess 32 in the center of its side surface. This recess co-acts with a ridge 33 shown in FIG. 7 in the outer face of the inner cylinder. Also shown in FIG. 7 is ridge 34 disposed on the back face of the inner cylinder which cooperates with the wafers in chambers 10 and 16.

Under normal operation the ridges will pass through the recess in wafer 29 and the lock will open normally. If the tamperer attempts to pick the lock, a wafer without a recess in either the first or last chamber will be stopped by the ridge 33 or 34 at a point directly on the angle of the trap pins. This will allow the trap pins to engage the hole in either the wafer or bottom pin. This prevents the use of a spring-propelled insert which would be used to by-pass the trap pins.

Once the trap pins are engaged, further tampering with the lock is prevented. If the lock has been picked, the wafer with the hole in the top is of sufficient thickness so as to prevent the trap pin and wafer together from being lifted into the trap chamber so that the lock could be further by-passed. If the lock has been impressioned, the impressioned key will be locked in the cylinder and cannot be removed since there is no trap pin for the first chamber position.

The significance of dimensions of the trap pins may be viewed with further detail by reference to FIG. 6. As shown in FIG. 6, the trap pins are engaged in a bottom pin as would occur when the lock has been impressioned. It can be seen that the dimensions of a wafer are such that further tampering cannot occur without removal of the entire cylinder from the door or other entrance for which the lock is designed.

The lock of this invention provides substantial improvements over the prior art in that it will prevent the various forms of lock tampering discussed above. The lock of this invention will also prevent tampering by the method of first picking and then spinning the cylinder rapidly. It also will lock the cylinder when tampering occurs, thus notifying the user that tampering has occurred.

It should be apparent to one of ordinary skill in the art that the foregoing is presented by way of example only. The invention is not to be unduly restricted thereby, since modifications may be made in the structure of the various parts without functionally departing from the spirit of this invention.

What I claim is:

1. A tamper-resistant lock comprising an outer cylinder adapted to be mounted in an entrance barrier; an inner cylinder rotatably mounted in said outer cylinder; a plurality of top pins disposed in chambers in said outer cylinder; said top pins being urged toward said inner cylinder; a plurality of bottom pins disposed in chambers in said inner cylinder; said chambers in the inner and outer cylinders being in alignment when the lock is locked; at least one wafer disposed between said top pins and said bottom pins in at least one of the chambers when the lock is locked; at least one of said wafers having a hole herein; at least one bottom pin having a hole therein; a plurality of trap pins mounted in trap pin chambers in the outer cylinder; said trap pins being urged toward the inner cylinder; said trap pins additionally having an extension thereon adapted to engage the hole in said wafer or said bottom pin when a wafer or a bottom pin having a hole herein passes a trap pin chamber.

2. A tamper-resistant lock comprising an outer cylinder adapted to be mounted in an entrance barrier; an inner cylinder rotatably mounted in said outer cylinder; a plurality of top pins disposed in chambers on said outer cylinder, said top pins being urged toward said inner cylinder; a plurality of bottom pins disposed in chambers in said inner cylinder, said chambers in the inner and outer cylinders being in alignment when the lock is locked; a plurality of wafers being disposed between at least one pair of said top and bottom pins when the lock is locked; at least one of said wafers having a recess in its side; at least one wafer being disposed between said top and bottom pins in the chambers not containing at least one wafer with a recess; at least one said wafer in chambers not containing at least one wafer with a recess having a hole therein; at least one trap mounted in a chamber in the outer cylinder; said trap pin being urged toward the inner cylinder; said trap pin additionally having an extension adapted to engage the hole in said hole bearing wafer when the lock is picked; a ridge mounted on either said inner or outer cylinder adapted to pass through the recess in said wafer containing a recess when the lock is opened normally and to stop the rotation of the inner cylinder at the angle of engagement of said trap pin when the lock is picked.

* * * * *